United States Patent [19]

Heaps

[11] 4,030,600

[45] June 21, 1977

[54] COLLAPSIBLE BULK SHIPPING CONTAINER

[75] Inventor: Harry D. Heaps, Bala Cynwyd, Pa.

[73] Assignee: Connelly Containers, Inc., Bala Cynwyd, Pa.

[22] Filed: June 26, 1975

[21] Appl. No.: 590,499

[52] U.S. Cl. ..... 206/386; 229/23 A; 229/46; 229/DIG. 1

[51] Int. Cl.[2] ..... B65D 19/06; B65D 45/00

[58] Field of Search ..... 229/23 R, 23 A, 23 BT, 229/49, DIG. 1, 17 B, 46, 47; 206/386, 453; 108/52, 58, 513, 51.3; 220/4 F; 217/12 R, 43

[56] References Cited

UNITED STATES PATENTS

| | | | |
|---|---|---|---|
| 315,476 | 4/1885 | Burns | 217/12 R |
| 1,020,536 | 3/1912 | Byrne | 229/17 B |
| 1,185,069 | 5/1916 | Carry et al. | 220/4 F |
| 1,690,853 | 11/1928 | Behrman | 229/46 |
| 1,772,255 | 8/1930 | Kondolf | 229/47 |
| 1,973,237 | 9/1934 | Vilas | 229/17 B |
| 2,124,409 | 7/1938 | Andrews | 229/47 |
| 2,651,588 | 9/1953 | Bruce et al. | 229/49 |
| 3,443,737 | 5/1969 | Kupersmit | 206/386 |
| 3,487,918 | 1/1970 | Roden et al. | 206/386 |
| 3,650,459 | 3/1972 | Tucker | 229/23 R |
| 3,675,765 | 7/1972 | Melsek | 206/386 |
| 3,770,186 | 11/1973 | Kupersmit | 229/23 R |

*Primary Examiner*—William Price
*Assistant Examiner*—Allan N. Shoap
*Attorney, Agent, or Firm*—Irvin A. Lavine

[57] ABSTRACT

A collapsible bulk shipping container comprising a pallet with a tray secured to it, the front wall of the tray having a flap at its mid-portion severed from the front wall and fastened down against the tray bottom, the flap edges providing spaced detents. A wall element has a back panel, two side panels and two partial front panels, and is resiliently urged to flat condition. When placed inwardly of the tray walls, the edges of the partial front wall panels engage the edges of the tray flaps, which thereby hold the wall element open, providing front entry for loading the container. A single front closure panel overlaps the partial front panels of the wall element, to close the entry, this panel extending between the tray walls and the partial front panels. A sealed closure is provided by a staple-like member having spaced parallel legs extending through aligned openings in the wall element, a wall of the top and a plate member, and a metal strap which encircles the plate member passes twice through the legs of the staple-like member and is secured by a seal. Cushioning elements are provided for the securing straps which encircle the container, being of L-shape and made of multiple layers of paperboard nested and adhered to each other.

16 Claims, 7 Drawing Figures

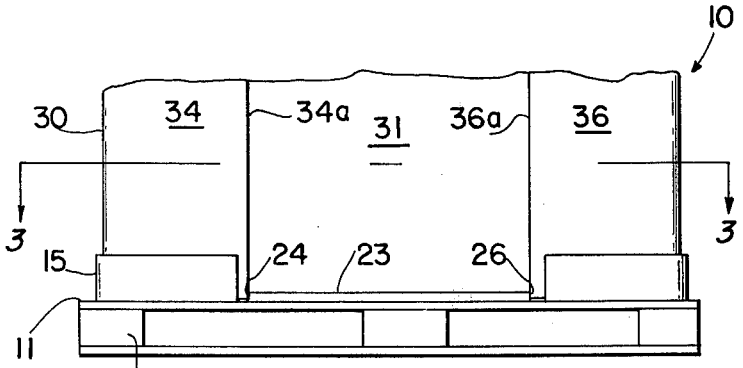
FIG. 2
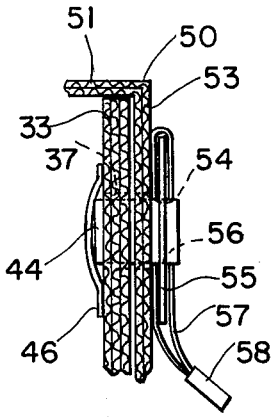
FIG. 5
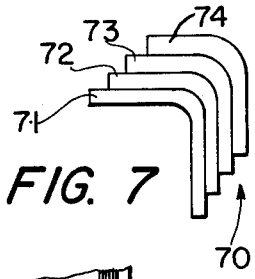
FIG. 7
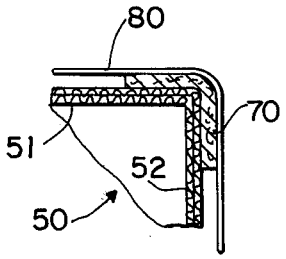
FIG. 6
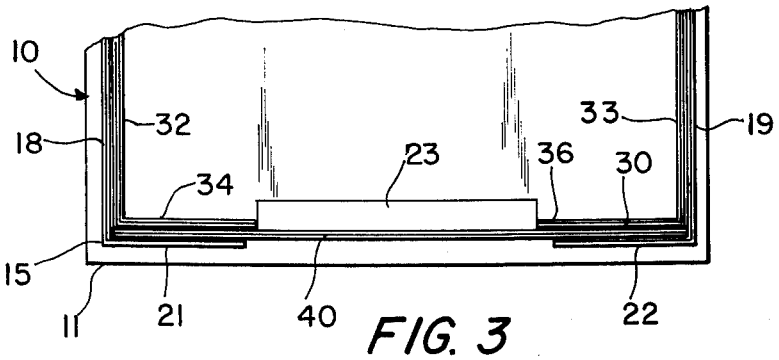
FIG. 3
FIG. 4
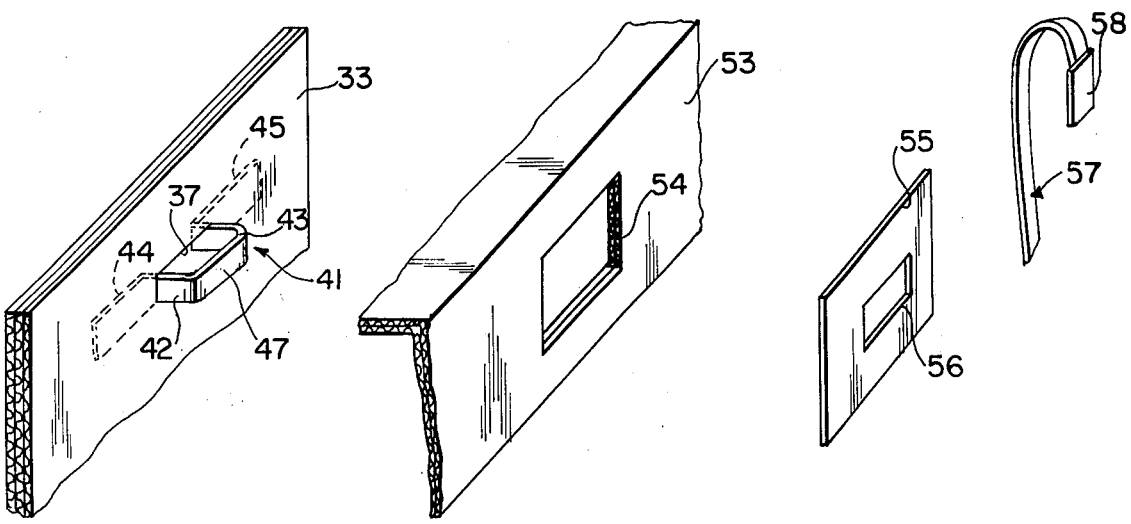

COLLAPSIBLE BULK SHIPPING CONTAINER

BACKGROUND OF THE INVENTION

The present invention pertains to collapsible bulk shipping containers.

There have been provided a number of structures in the prior art for so-called containerized shipment. These constructions provide relatively large containers, into which a number of smaller cartons are placed until the container is substantially filled. These containers are of relatively large size, having an internal volume of almost 180 cubic feet. They are made of corrugated paperboard, often of the so-called double or triple wall variety. Typically, the containers may be provided as a kit, with some part of the container itself secured to a pallet. Typically, there are provided a bottom and a wall-forming element or elements which may be shipped in flattened condition, stored in or upon the bottom and pallet, and closed or partially closed by the top. These prior art constructions, to be described in more detail hereinbelow, have various deficiencies, which are overcome by the present invention container.

In one prior art construction, a wall-forming element comprised back wall and sidewall panels, and a pair of front wall flaps, providing a front entry. The wall-forming element was secured to the bottom and to the pallet, and clips were provided to join the fornt panels to a sliding door member, thereby requiring additional parts and extra expense.

In another construction, a composite front wall was provided, made up of two panels elements joined together by a clip in the form of an I-beam in cross section, and in addition a raised internal rail was provided, such construction being unduly complex and expensive.

Another suggestion in the prior art shows a front wall panel secured by clips to a carton construction having upstanding rails, of a particular shape, thereby requiring substantial excessive expense.

In still another construction in the prior art, the body-forming element was provided with bottom flaps, and in erecting the carton, this body-forming element was placed within a tray, with the bottom flaps horizontal, and the bottom layers of the articles being loaded were placed upon the bottom flaps so that the weight of articles placed within the container and bearing on the flaps was used to anchor the body-forming portion or element in position.

In connection with such containers, as well as other containers, it is known that the goods or articles being shipped are large in quantity, and are sometimes quite valuable, thereby attracting unauthorized entry and pilferage. Such containers have not been provided with suitable securing means to prevent entry.

Still further, such containers are usually closed by a separate top, which is placed on the body-forming element, after loading and after a front wall or front panel is in place. After that, conventional steel strapping is applied to secure the parts together and form a complete container. These straps often cut into and damage the container, particularly the top, so that the container has a limited amount of reuse. While cushioning devices or guards have been provided in the past in connection with such straps, they have required plastic molding, or the like, and have been unduly expensive.

SUMMARY OF THE INVENTION

A collapsible bulk shipping container is provided, and includes a pallet having a tray secured to its upper surface. The tray has periphally extending walls, with the front wall having a flap severed from its midportion, the flap being fastened down in generally horizontal position. The two side edges of the flap which were cut from the front wall of the tray provide spaced detents. A wall element is provided, being a sheet of corrugated paperboard of suitable strength, and having five panels defined by four spaced parallel aprallel fold lines. These include a back or rear panel, two side panels, and two partial front panels at the ends of the wall element. The fold lines between the rear and side panels tend to cause the side panels to occupy positions substantially parallel to the rear panel, so that when the wall which edges form detents to prevent movement of the side panels toward each other element is erected within the tray, the resiliency thereof tends to move the side panels towards each other, and this is prevented by engagement of the edges of the partial front walls with the edges of the turned-down flap of the tray front wall. Thus, the entry of the wall element is substantially co-extensive with the space between the upstanding portions of the front wall of the tray. Closure of the front entry is by a single front closure panel which is of substantially the same size as the rear panel of the wall element. Due to the fact that the external dimensions of the side walls of the wall element are slightly shorter than the internal dimensions of the side walls of the tray, the front closure panel has space to fit between the front wall elements of the tray and the partial front panels of the wall element. A top is provided, preferably of conventional telescopic construction, to provide a top closure.

To provide for security against pilferage, there is provided adjacent the upper edges of each of the side wall elements a horizontal elongate opening. A staple-like member is provided having a pair of parallel legs which extend outwardly through this opening, each leg having a transverse element at its inner end which engages the inside of the side wall, which transverse portions may be secured to the inner surfaces of the side walls by adhesive tape materials, or the like. The depending side walls of the top are also provided with openings which are in alignment with the openings in the side wall element, the legs of the staple-like member passing through each of these openings, also. A plate member is provided, also having an aperture, and this is placed over the outside of the side wall of the top, receiving the legs of the staple-like member, with the bight thereof outwardly of the plate member, and generally parallel to it. A bendable metal strap encircles the plate member having a first portion passing on the rear of the plate member and between the legs of the staple-like member, and another portion passing on the front of the plate member, and also between these legs: A suitable seal of known construction is used to secure the two ends of the encircling member together, so that the encircling member must be cut in order to gain access to the interior of the container.

Steel straps are used to secure the loaded container, and in particular to hold the top down against the wall element, and to retain the articles within the container. In order to prevent cutting of the top by these steel straps, the top is provided with L-shaped cushioning elements, each made of paperboard or chip board, each being made of plural layers of L-shape positioned in nesting relationship, and secured to each other by adhesives.

Among the objects of the present invention are the provision of a collapsible bulk shipping container of economical construction, adequate strength, and which is made of simple, easily fabricated parts.

Yet another object of the present invention is to provide such a container which may be shipped as a knocked-down unit, and readily erected for loading.

Other objects of the present invention include the provision of such a container which is capable of multiple reuses, and which permits ease of entry thereinto for loading.

Still another object of the present invention is to provide a collapsible bulk shipping container which may be held in the open position without resort to fastening means, or the use of the articles being loaded in order to hold the parts of the container.

Still another object of the present invention is the provision of a container which will permit the front closure to be readily slid into place in a space provided for it, without the use of expensive clips, or the necessity for notching the juncture between walls or wall elements at right angles to each other.

Yet another object of the present invention is to provide a front entry collapsible bulk shipping container having an extremely simple wall element for forming rear and side walls and partially forming the front wall, and a similar simple single panel front closure element.

Yet another object of the present invention is the provision of a container and a suitable seal for the container to secure it against pilferage and unauthorized opening thereof.

Yet another object of the present invention is the provision of a container which is held in closed position by steel straps, with adequate cushioning for the steel straps to permit repeated reuses of the container.

Other objects and many attendant advantages of the present invention will be readily understood from the following description and claims.

BRIEF DESCRIPTION OF THE DRAWINGS

FIG. 2 is an elevational view of the lower portion of the container of the present invention, during assembly.

FIG. 3 is a cross-sectional view taken on the line 3—3 of FIG. 2, with the front closure panel in place.

FIG. 4 is an exploded perspective view of the anti-pilferage means forming a part of the container shown in FIG. 1.

FIG. 5 is a view showing the parts of FIG. 4 in assembled relationship.

FIG. 6 is a cross-sectional view showing the top of the present invention container, with a steel strap and cushioning element in place.

FIG. 7 is an enlarged elevational view of the cushioning element of FIG. 6.

DESCRIPTION OF THE PREFERRED EMBODIMENT

Figure 1:
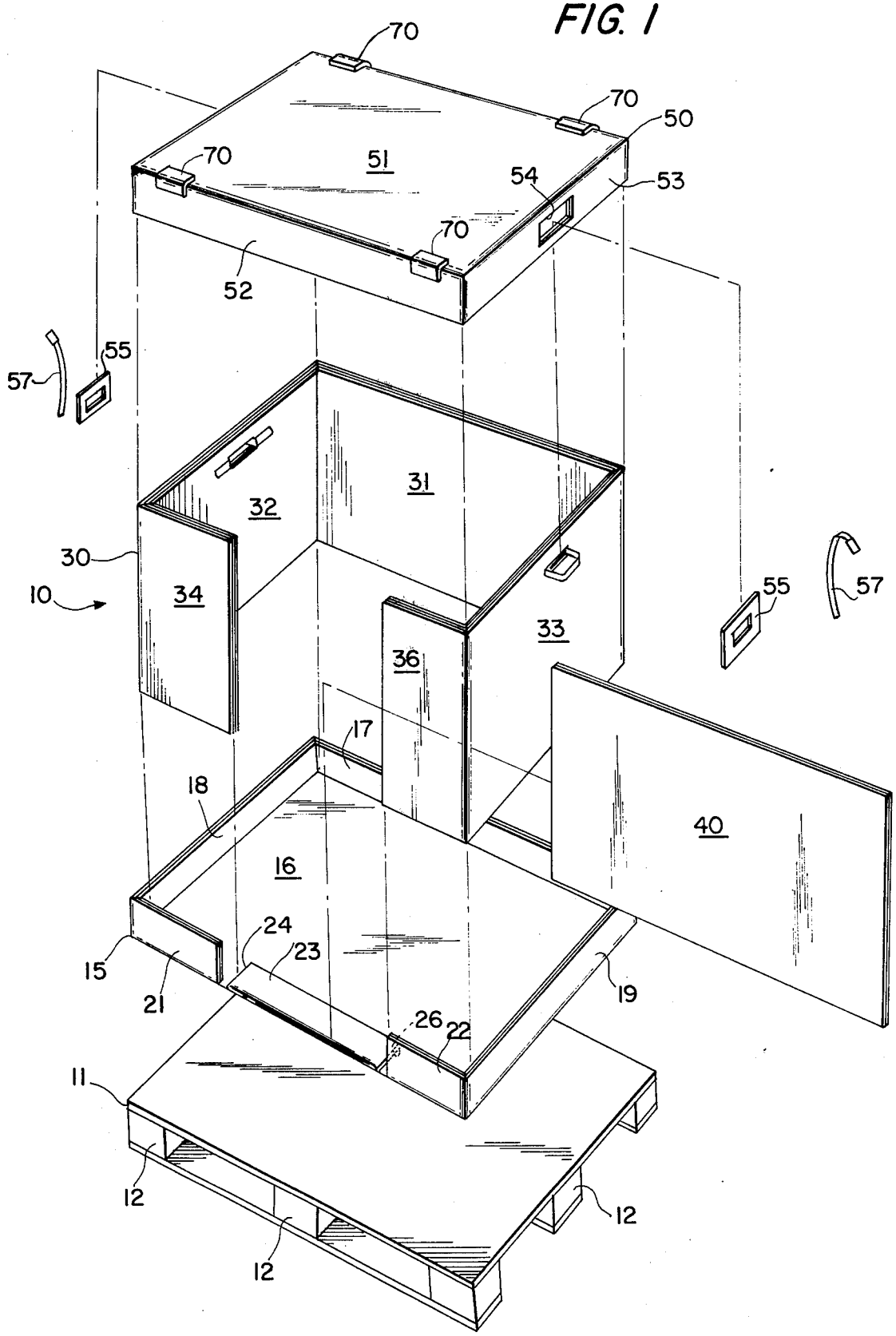
FIG. 1 is an exploded perspective view of a collapsible bulk shipping container in accordance with the present invention.

Referring now to the drawings, wherein like or corresponding reference numerals are used for like or corresponding parts throughout the several views, there is shown in FIG. 1 a collapsible bulk shipping container 10 in a accordance with the present invention. The container 10 comprises a pallet 11 of known construction, having feet 12 which are in spaced apart relationship to provide for entry of the fork of a lift truck.

A tray 15 is provided, which is secured to the pallet 11, as by suitable nails (not shown). The tray 15 comprises a tray bottom or plate 16, here shown to be substantially co-extensive with the top of the pallet 11. Tray 15 also includes an upstanding rear wall 17 and upstanding side walls 18 and 19, said walls being peripherally extending in relation to the platform 11 and bottom 16. There are also provided a pair of spaced partial front walls 21 and 22: a flap 23 has been severed from the front wall, and positioned horizontally, being fastened in such horizontal position and against the bottom 16, as by nails or the like. There are thus provided a pair of edges 24 and 26 which, due to the thickness of the flap 23, extend above the upper surface of the bottom 16.

A collapsible, upstanding and peripherally extending wall element 30 is provided, the wall element including a rear wall or rear wall panel 31, a pair of side wall panels 32 and 33, and a pair of partial front wall panels 34 and 36. All of the panels are joined by fold lines, in conventional manner, and as will be understood, the wall element 30 as well as the tray 15 are preferably made of multi-wall corrugated board, scored to provide the fold lines. The linear extend of the partial front wall panels 34 and 36 is substantially the same as that of the tray partial front walls 21 and 22. The wall element 30 is shipped in substantially flat condition, so that the five panels 32 and 33 overly and are parallel or almost parallel to the back panel 31. Hence, when the wall element 30 is erected generally into the position shown in FIG. 1, and is placed within the upstanding walls of the tray 15, the walls 32 and 33, due to the resiliency of the material, tend to move towards each other, about the fold lines between the side panels 32 and 33, and the back panel 31. As shown in FIG. 2, however, this is prevented due to the engagement of the lower portions of the edges **34*a* and 36*a* of the partial front walls 34 and 36, respectively, with the edges 24 and 26 of the down turned front wall flap 23 of the tray 15, which edges 24 and 26 serve as detents. Thus, the wall panels 32 and 33 are held substantially parallel to each other and substantially perpendicular to the rear panel 31, thereby providing full front entry into the container 10** for the placement of articles therewithin.

Referring again to FIG. 1, the distances between the outside surfaces of the back panel 31 and the partial front wall panels, 34 and 36 is less than the distance between the inside of the tray rear wall 17 and the inside of the tray partial front walls 21 and 22. The difference in these lengths approximate the thickness of a front closure panel 40, made of a single sheet of corrugated board or other suitable material, without scores, folds, or flaps. As shown in FIG. 3, the front closure 40 is positioned between the tray partial front walls 21 and 22 on the one hand, and the wall element 30 partial front walls 34 and 36, on the other hand, space therefor being provided by the above-noted dimensional differences between the wall element 30 and the tray 15. In FIG. 3, the container is shown without articles within it, for purpose of clarity, it being understood that the front closure panel 40 is placed in the position shown in FIG. 3 only when the container 10 has been substantially filled.

As shown in FIG. 1, a top 50 is provided which is basically of conventional telescope top construction, and including a top panel 51, front panel 52, a side panel 53, and an additional side panel and a rear panel, not visible in FIG. 1.

On the top 50 there are mounted cushioning elements 70, suitably positioned so as to protect the top 50 from damage by the usual steel strapping applied to such containers.

Referring now to FIGS. 4 and 5, there is shown a portion of the side wall panel 33, adjacent the upper edge thereof. An opening 37 is provided, generally elongate shaped. A staple-like member 41 includes a pair of spaced, substantially parallel legs 42 and 43, each having at its inner end a transverse portion 44, 45. The transverse portions 44 and 45 are preferably secured against the inside of side wall 33 by suitable means, such as the adhesive tape 46 (FIG. 5). At their outer ends, the legs 42 and 43 are connected by a bight 47.

The depending side wall 53 of the top 50 is provided with an elongate opening 54. A plate member 55 is provided, preferably of a suitable strong material, and having a transverse opening 56 therein. Plate member 55 is positioned as shown in FIG. 5 with one face adjacent the outer surface of side wall 53.

Finally, there is included in the assembly shown in FIG. 4 a bendable metal strap 57 of known construction, and having a clamp type seal 58, which is of the type that may be clamped on to the free or opposite end of the strap 57, to secure these ends together and form a loop around plate 55 in such a manner that either cutting of the strap or destruction of the seal 58 are required. Such devices are well known, particularly in connection with security sealing of packages, railway car doors and the like.

Referring to FIG. 5, the elements shown in FIG. 4 are shown in assembled, secured relationship, and somewhat spread apart for purposes of clarity. Thus there is shown the transverse portion 44 of the staple-like member 41, the side wall panel 33 and the top 50 including a portion of the top panel 51 and the side panel 53, and it will be observed that the openings 37, 54, and 56, are in substantial alignment with each other. The strap 57 encircles the plate member 55, passing to the left or rear of the adjacent face of it, and between it and the outer surface of the side wall 53 of top 50. In doing so, it passes between the parallel legs of the staple-like member 51. The strap 57 passes also on the front of the plate member 55, and for the second time passes between the parallel legs 42 and 43 of the staple-like member 41. The seal 58 is shown in closed position on the opposite end of the strap 57, thereby securing the top 50 in closed position, against pilferage.

Although not shown on the drawing, the locking construction shown in FIGS. 4 and 5, is preferably provided also on the walls 18 and 19 of the tray 15, and/or on wall 17 and one or both of walls 21 and 22, to provide security for and between wall element 30 and tray 15.

Referring to FIG. 6, there is shown the top 50, including the top panel 51 and front panel 52, at the juncture or edge of which is provided a cushioning element 70. A steel strap 80, of conventional construction, passes over the cushioning element 70, which thereby protects the top 50 from being damaged by it. As shown in FIG. 7, which is an enlarged view of the cushioning element 70, it will be seen that cushioning element 70 is made up of a number of substantially identical L-shaped elements 71, 72, 73 and 74. These are each made of substantially the same size of paperboard or chipboard, and are assembled in the shown nesting relationship by applying adhesive (not shown) to the mating surfaces. Thus, the cushioning element 70 is of extremely economical construction while sufficing to perform its function of protecting the top 50 against damage. Preferably, the cushioning element 70 is attached to the top 50, as by suitable adhesive.

There has been provided a collapsible bulk shipping container of suitable strength, preferably made from readily available multi-ply corrugated board. It is of simple and therefore economical construction, capable of repeated reuse, and erection by the user, without requiring adhesives, staple guns or other similar attaching tools. Further, the herein set forth collapsible bulk shipping container provides for ease of entry, and although shipped flat with the wall element tending, due to resiliency, to return to the collapsed position, the wall element is held in the full open position for ease of entry by a unique detent provided by a down-turned portion of the tray front wall.

Further, the herein disclosed collapsible bulk shipping container may be closed by a simple, single front wall closure panel positionable between the partial front wall of the tray and the partial front wall of the wall element.

In addition, there has been disclosed a superior and effective antipilferage means, and an economical and protective cushioning member.

It will be obvious to those skilled in the art that various changes may be made without department from the spirit of the invention and therefore the invention is not limited to what is shown in the drawings and described in the specification but only as indicated in the appended claims.

I claim:

1. A collapsible bulk shipping container comprising:
   a. a pallet,
   b. a rectangular tray secured to said pallet and comprising:
      i. plate means secured to the upper surface of said pallet,
      ii. upstanding peripheral wall means, and
      iii. detent means overlying said plate means at spaced locations about a said upstanding wall means, said detent means comprising the edges of a flap severed from said wall means,
   c. a collapsible upstanding, peripherally extending wall element within said upstanding wall means of said tray and comprising a blank scored to provide three container wall panels and a pair of partial wall panels at opposite ends of said blank, said wall element having a resiliency at the scores thereof urging said partial wall panels toward each other, said partial wall panels being adjacent said upstanding wall means having said detent means therealong, the edges of said partial wall panels being in engagement with said detent means,
   d. a closure panel extending across the space left by said partial wall panels, and
   e. a top for closing said container in cooperative juxtaposition with said wall element.

2. The collapsible bulk shipping container of claim 1, said closure panel extending parallel to said partial wall panels and adjacent thereto, said closure panel extending across the space between the edges of said partial wall panels.

3. The collapsible bulk shipping container of claim 2, said closure panel being a single, separate panel element.

4. The collapsible bulk shipping container of claim 2, said closure panel being between the upstanding wall means of said tray and the partial wall panels.

5. The collapsible bulk shipping container of claim 1, said wall element comprising a back panel, a pair of side wall panels, said pair of partial wall panels being partial front wall panels, said peripheral wall means of said tray comprising a back wall, a pair of side walls and front wall means, the distance between the outside surfaces of the wall element back panel and front wall panel plus the thickness of the closure panel being substantially equal to the distance between the tray back wall and the tray front wall means.

6. The collapsible bulk shipping container of claim 1, and means securing said flap in substantially horizontal position.

7. The collapsible bulk shipping container of claim 1, and a wall of said top outwardly of and adjacent to said collapsible wall element and having an opening therein, a plate member having an opening in alignment with said first opening, and positioned with one face thereof adjacent to the outer surface of said wall of said top, a staple-like member having a pair of spaced, generally parallel legs extending through said openings and having a bight outwardly of said wall of said top member, means securing said staple-like member to said container, longitudinally extending securing means extending between the said plate member and said wall of said top member and between the legs of said staple-like member, and thence adjacent the opposite face of said plate member and through said legs of said staple-like member, and seal means securing portions of said securing means together into a loop around said plate member.

8. The collapsible bulk shipping container of claim 7, wherein said collapsible wall element has an opening therein in alignment with said openings, and said legs of said staple-like member extending therethrough.

9. The collapsible bulk shipping container of claim 8, and means securing said staple-like member to said wall element 10. The collapsible bulk shipping container of claim 1, and securing strap means encircling said container and passing over the top thereof, cushioning means on said top at the edges thereof underlying a said strap means, said cushioning means being an L-shaped member comprising plural layers of paperboard, and means securing said layers together.

11. The collapsible bulk shipping container of claim 10, said last mentioned means being adhesive.

12. In combination, a container including a side wall and a closure member, and means for securing said side wall and member in assembled closed conditon comprising:

a wall of said member outwardly of and adjacent to said container side wall and having an opening therein, a plate member having an opening therein, and positioned with one face adjacent the outer surface of said wall of said member, said openings being in alignment, a staple-like member having a pair of spaced, generally parallel legs extending through said openings and having a bight outwardly of said wall of said top member, means securing said staple-like member to said container, longitudinally extending securing means extending between the said face of said plate member and said wall of said top member and between the legs of said staple-like member, and thence adjacent the opposite face of said plate member and through said legs of said stapel-like member, and seal means securings portions of said securing means together into a loop around said plate member.

13. The combination of claim 12, wherein said container side wall has an opening therein in alignment with said openings, and said legs of said staple-like member extending therethrough.

14. The combination of claim 13, said legs of said staple-like member each having a transverse portion inwardly of said container side wall.

15. The combination of claim 14, and means securing said transverse portions to said container side wall.

16. In combination, a container including a side wall and a closure member, and means for securing said side wall and member in assembled closed condition comprising:

a wall of said member outwardly of and adjacent to said container side wall and having an opening therein, a plate member having an opening therein, and positioned with one face adjacent the outer surface of said wall of said member, said openings being in alignment, a staple-like member having a pair of spaced, generally parallel legs extending through said openings and having a bight outwardly of said wall of said top member, means securing said staple-like member to said container, longitudinally extending securing means extending in a loop around said plate member, passing between said face of said plate member and the said wall of said top member and passing adjacent the opposite face of said plate member, said securing means passing at least once through the legs of said staple-like member, and seal means securing portions of said securing means together into said loop around said plate member.

* * * * *